United States Patent [19]

Yoshida et al.

[11] Patent Number: 4,481,555

[45] Date of Patent: Nov. 6, 1984

[54] ELECTROMAGNETIC CONTACT DEVICE

[75] Inventors: Masayuki Yoshida; Fumio Matsumoto; Shigeharu Otsuka, all of Nagoya, Japan

[73] Assignee: Mitsubishi Denki Kabushiki Kaisha, Tokyo, Japan

[21] Appl. No.: 420,913

[22] Filed: Sep. 21, 1982

[30] Foreign Application Priority Data

Sep. 24, 1981 [JP] Japan ..... 56-151258

[51] Int. Cl.[3] ..... H01H 47/10

[52] U.S. Cl. ..... 361/155; 361/156; 361/194; 361/206

[58] Field of Search ..... 361/154, 155, 156, 194, 361/206

[56] References Cited

U.S. PATENT DOCUMENTS 3,943,416 3/1976 Degenhart ..... 361/194

FOREIGN PATENT DOCUMENTS 448549 6/1936 United Kingdom ..... 361/156
455278 10/1936 United Kingdom .
539343 9/1941 United Kingdom .
565614 11/1944 United Kingdom .
584880 1/1947 United Kingdom .
877036 9/1961 United Kingdom .
1019008 2/1966 United Kingdom .
1037081 7/1966 United Kingdom .

*Primary Examiner*—Reinhard J. Eisenzopf
*Attorney, Agent, or Firm*—Oblon, Fisher, Spivak, McClelland & Maier

[57] ABSTRACT

An electromagnetic contact device performs on-off operations for opening and closing an electrical path, without causing the hunting phenomenon between the two contact points in the device not only during closure of a fixed contact point and a movable contact point therein, but also when a voltage to be applied to an operating coil has lowered. An operating coil generates a predetermined energizing force in combination with a fixed iron core, a starting circuit rectifies a large capacity electric current from an AC power source when attracting a movable iron core and supplies the rectified current to the operating coil. A holding circuit supplies the large capacity current from the AC power source to the operating coil through means of converting the large capacity current to a small capacity current at the time of holding the movable iron core. A change-over switch changes the energizing current supply source for the operating coil from the starting circuit to the holding circuit, the change-over switch having a hysteresis characteristic such that it performs its off-operation after closure of both contact points when the main circuit is closed, and performs its on-operation after separation of both contact points when the voltage to be applied to the operating coil has been lowered.

7 Claims, 21 Drawing Figures

ELECTROMAGNETIC CONTACT DEVICE

BACKGROUND OF THE INVENTION

1. Field of the Invention

This invention relates to an electromagnetic contact device, and more particularly, it is concerned with an electromagnetic contact device to perform on-off control operations of an electric path, through which electric power is supplied to a device such as an electric motor.

2. Description of the Prior Art

There has previously been used a device as shown in FIG. 1 of the accompanying drawing as an electromagnetic contact device.

That is, as shown in the drawing, a box-shaped fitting plate 32 is provided for mounting the main body of the electromagnetic contact device on a mounting table. The main body of the electromagnetic contact device is screw-fitted on the mounting table through a plurality of fitting holes 33 formed in the fitting plate 32.

A base 11 made of an insulating material is fixedly secured on this fitting plate 32 by means of fitting screws 28. A terminal plate 12 to connect the electromagnetic contact device with a main circuit is, in turn, fixed on this case 11. A fixed contact piece 13 provided with a fixed contact point 14 is secured on this terminal plate 12 in an electrically conductive manner with the same. Further, as shown in FIG. 1, a cross-bar 4 made of an insulating material is provided on this base 11 in a manner so as to be movable up and down. The cross-bar 4 is upwardly biased in FIG. 1 by a take-off spring 31 compressed between a spring receptacle 100 formed at the bottom end of this cross-bar 4 and the fitting plate 11. In a supporting hole **4*a* formed in the cross-bar 4, there is inserted a movable contact piece 8 provided with a movable contact 6 disposed in confrontation with the above-mentioned fixed contact 14. The movable contact piece 8 is downwardly biased, in FIG. 1, by a spring 9 for the contact piece and installed in a compressed state between a spring receptacle 101 formed in the cross-bar 4 and a spring support 102**.

In order to drive the above-mentioned movable contact 6 and to perform the contact opening and closing actions in cooperation with the fixed contact 14, there is provided a drive mechanism to be explained in the following.

A fixed iron core 20 manufactured by laminating silicon steel plates is disposed on the fitting plate 32. A plurality of pins 24 are inserted into this fixed iron core 20. Both ends of each of the pins 24 are capped buffer rubber 25. A buffer spring 103 is provided between the fitting plate 32 and the buffer rubber 25. A movable iron core 18 is fixedly fixed at the bottom end of the above-mentioned cross-bar 4 by a pin 19. The movable iron core 18 is disposed in confrontation with the fixed iron core 20 with a predetermined space interval between them. An operating coil 22 is wound around a coil supporting frame 104 mounted on the fixed iron core 20 for attracting the movable iron core 18 to the fixed iron core 20 by imparting electromagnetic force to the latter. The operating coil 22 and a coil terminal 36 are mutually connected through a lead wire 43.

Furthermore, in order to extinguish an arc which occurs at the time of opening and closing the contact, an arc box 1 made of a heat-resistant material is fixed on the base 11 with screws 105. In this arc box 1, there are provdied grids 2 made of a magnetic metal material and so formed as to encompass the movable contact 6 and the fixed contact 14. By these grids 2, the arc is led out and extinguished.

An energizing voltage for the above-mentioned operating coil 22 is not required to be maintained at a constantly high level, but only a low level energizing voltage may be supplied to it after closure of the main circuit. Therefore, the energization of the operating coil 22 is accomplished by a circuit as shown in FIG. 2 of the accompanying drawing.

For rectifying an alternating current voltage from an AC power source 106 and supplying the energizing current to the operating coil 22, there is provided a rectifying circuit 107, to which a holding circuit 109 having an energizing voltage dividing resistor 108 for the operating coil 22 is connected in series. Moreover, a closure completion switch 110 is connected in parallel with the holding circuit 109. This closure completion switch 110 is so constructed that it may perform off-operation at the closure timing of both fixed and movable contacts 14 and 6 when the main circuit is closed, and that it may perform on-operation at the opening timing of contacts 14 and 6 when a voltage to be applied to the above-mentioned operating coil 22 becomes lowered. Furthermore, for performing the energizing operation of the operating coil 22, a switch 111 is connected to the AC power source 106.

In the following, explanations will be given as to the functions of the conventional electromagnetic contact device of the above-described construction.

When the switch 111 is closed in a state of contacts 14, 6 being separated, an alternating current voltage from the AC power source 106 is rectified by the rectifying circuit 107 on account of the closure completion switch 110 performing its on-operation, whereby an energizing current of a large capacity is supplied to the operating coil 22. As a result of this, electromagnetic attractive force occurs between the fixed iron core 20 and the movable iron core 18, whereby the movable iron core 18 is attached to the fixed iron core 20 against the force of the take-off spring 31. With this attraction, the cross-bar 4 connected with the movable iron core 18 shifts toward the fixed iron core 20, and the movable contact 6 of the movable contact piece 8 supported by the cross-bar 4 contacts the fixed contact 14 of the fixed contact piece 13. In this case, since a core gap formed between the movable iron core 18 and the fixed iron core 20 is larger than the contact gap between the movable contact 6 and the fixed contact 14, the cross-bar 4 further shifts toward the fixed iron core 20 to a point past the contact position of the above-mentioned contact points. On account of this, the spring 9 for the contact piece is deformed by compression, and the spring pressure is transmitted to the movable contact piece 8 through the spring support 102 to close the contact points with a predetermined contact pressure.

In the state of the contacts 14, 6 being closed, the closure completion switch 110 is switched to perform its off-operation, so that the alternating current voltage from the AC power source 106 is rectified by the rectifying circuit 107 only after being divided by the holding circuit 109, so that only a small energizing current is supplied to the operating coil 22.

When the drive voltage which has been applied to the operating coil 22 is removed, the electromagnetic attractive force between the fixed iron core 20 and the movable iron core 18 is extinguished, and the cross-bar 4 shifts away from the fixed iron core by the biasing force of the compressed take-off spring 31, whereby the contact points are separated. At this instant, there is generated an arc across the movable contact point 16 and the fixed contact point 14. However, this arc is drawn into the grids 2 surrounding the portion of the above-mentioned contact points, cooled and cut apart for extinction.

However, in view of the fact that the conventional electromagnetic contact device is so constructed that it may perform its off-operation at the closure timing of contact points 14, 6 when the closure completion switch 110 closes the main circuit, and that it may perform on-operation at the opening timing of contact points 14, 6 when a voltage to be applied to the operating coil 22 becomes lowered, as mentioned in the foregoing, there arise various problems to be described hereinbelow due to even a slight error in the on-and-off operation timing of the closure completion switch 110.

FIGS. 3A and 3B are graphical representations indicating a relationship between a spacing of iron cores 20, 18 and an iron core attracting force at the closure of the main circuit, and at the time of lowering of the voltage applied to the operating coil 22, respectively. In the drawing, the biasing force of the take-off spring 31 is indicated by a dash line, the biasing force of the contact piece spring 9 by a dot-and-dash line, and the core attracting force by a solid line.

In the state of the main circuit being open, when the switch 111 is closed, the core attracting force gradually increases as shown in FIG. 3A, during which the distance between iron cores 20, 18 decreases gradually from a point $H_1$. In this case, if it is assumed that the off-operation timing of the closure completion switch 110 comes before the closure of contact points 14, 6, then the closure completion switch 110 may perform its off-operation as soon as the distance between cores 20, 18 reaches a point $H_2$ where the core attracting force decreases from $F_1$ to $F_2$ and again increases. However, at a time instant when the distance between iron cores 20, 18 reaches a point $H_3$, i.e., when contact points 14, 6 are closed, since the core attracting force $F_3$ is weaker than a sum $F_4$ of the biasing force of the take-off spring 31 and the biasing force of the contact piece spring 9, the movable iron core 18 stops its shifting at a position where the distance between cores 20, 18 reaches the point $H_3$. While maintaining the distance between iron cores 20, 18 at the point $H_3$, the core attracting force gradually increases and, at a point where the core attracting force becomes stronger than the sum $F_4$ of the biasing force of the take-off spring 31 and the biasing force of the contact piece spring 9, the movable iron core begins to shift again, whereby iron cores 20, 18 come into contact.

As the consequence of this, no predetermined contact pressure can be obtained between contact points 14, 6 due to stoppage of the movable iron core 18, as mentioned above, to disadvantageously result in fusion of contact points 14, 6 or burning of the operating coil 22.

When a voltage to be applied to the operating coil 22 lowers when the main circuit is closed, the core attracting force gradually decreases from a point $F_5$ as shown in FIG. 3B, during which the distance between iron cores 20, 18 increases gradually. In this case, if it is assumed that the on-operation timing of the closure completion switch 110 comes before separation of contact points 14, 6, the closure completion switch 110 performs its on-operation when the distance between iron cores 20, 18 reaches a point $H_4$, whereby the core attracting force increases from $F_6$ to $F_7$, and decreases again. However, at a time instant when the distance between iron cores 20, 18 reaches the point $H_3$, i.e., when contact points 14, 6 move apart, since the iron core attracting force $F_8$ is stronger than the biasing force of the take-off spring 31, the movable iron core 18 stops its movement at a position where the distance between iron cores 20, 18 reaches the point $H_3$, and the iron core attracting force gradually decreases while maintaining the distance between iron cores 20, 18 at $H_3$. Then, as soon as the core attracting force becomes weaker than the biasing force of the take-off spring 31 at $F_9$, iron cores 20, 18 are separated.

As the result, no predetermined contact pressure can be obtained between contact points 14, 6 due to stoppage of the above-mentioned movable iron core 18, and the contacts 14, 6 are fusion-bonded together or the operating coil 22 is burnt. In particular, when the voltage to be applied to the operating coil 22 lowers to a level between $F_6$ and $F_9$, owing to the troubles in the device, the above-mentioned fusion-bonding between the two contact points 14, 6 and burning of the operating coil 22 becomes considerable, because the above-mentioned movable iron core 18 continues its stoppage.

SUMMARY OF THE INVENTION

The present invention has been made in view of the various problems to be solved in the conventional electromagnetic contact device, as mentioned in the foregoing.

It is therefore the primary object of the present invention to provide an electromagnetic contact device which performs on-off control operations to open and close an electrical path, through which electric power is supplied to various electric appliances and apparatuses, such as for example an electric motor, etc., without causing a hunting phenomenon between the two contact points not only at the time of the closure of the fixed contact point and the movable contact point, but also at the time of lowering of the voltage to be applied to the operating coil, thus preventing the undesirable fusion-bonding from occurring between the contact points.

According to the present invention, in its general aspect, there is provided an electromagnetic contact device to attain the above-mentioned object of the present invention, which includes a base member on which a fixed contact point is mounted, a cross-bar provided on the base member in a freely slidable manner and on which a movable contact point to open and close a main circuit in cooperation with the fixed contact point is mounted, a movable iron core mounted on the cross-bar for shifting the movable contact point in cooperation with the fixed iron core, an operating coil to generate a predetermined energizing force in combination with the fixed iron core, a starting circuit to rectify electric current in a large capacity from an AC power source at the time of attracting the movable iron core and to supply the rectified current to the operating coil, a holding circuit to supply the above-mentioned large capacity current from the AC power source to the operating coil through means of converting the large capacity current to a small capacity current at the time of holding the movable iron core, and a change-over switch to change the energizing current supply source for the operating coil from the starting circuit over the holding circuit. The change-over switch has a hysteresis characteristic such that it may perform its off-operation after closure of both contact points when the main circuit is closed, and perform its on-operation after separation of both contact points when the voltage to be applied to the operating coil lowers.

There has thus been outlined, rather broadly, the more important features of the present invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception, upon which this disclosure is based may readily be utilized as a basis for the designing of other structure for carrying out the several purposes of the present invention. It is important, therefore, that the claims be regarded as including such equivalent construction so far as they do not depart from the spirit and scope of the present invention.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
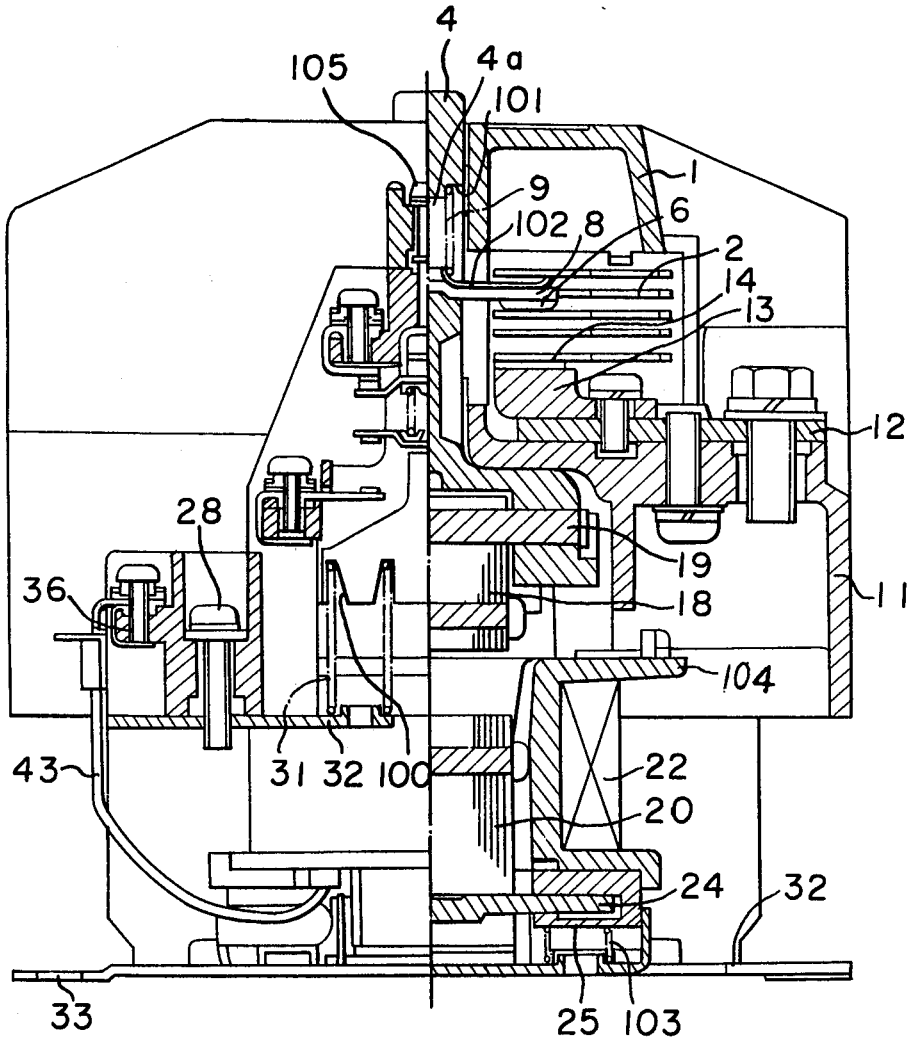
FIG. 1 PRIOR ART
FIG. 1 is a cross-sectional view of the main part of a conventional electromagnetic contact device.

FIGS. 4–11 illustrate the first preferred embodiment of the electromagnetic contact device according to the present invention. Note should be taken that, in the drawing, those component parts corresponding to those in the conventional electromagnetic contact device as already explained in reference to FIG. 1 are designated by the same reference numerals for simplicity in the explanation.

Figure 4:
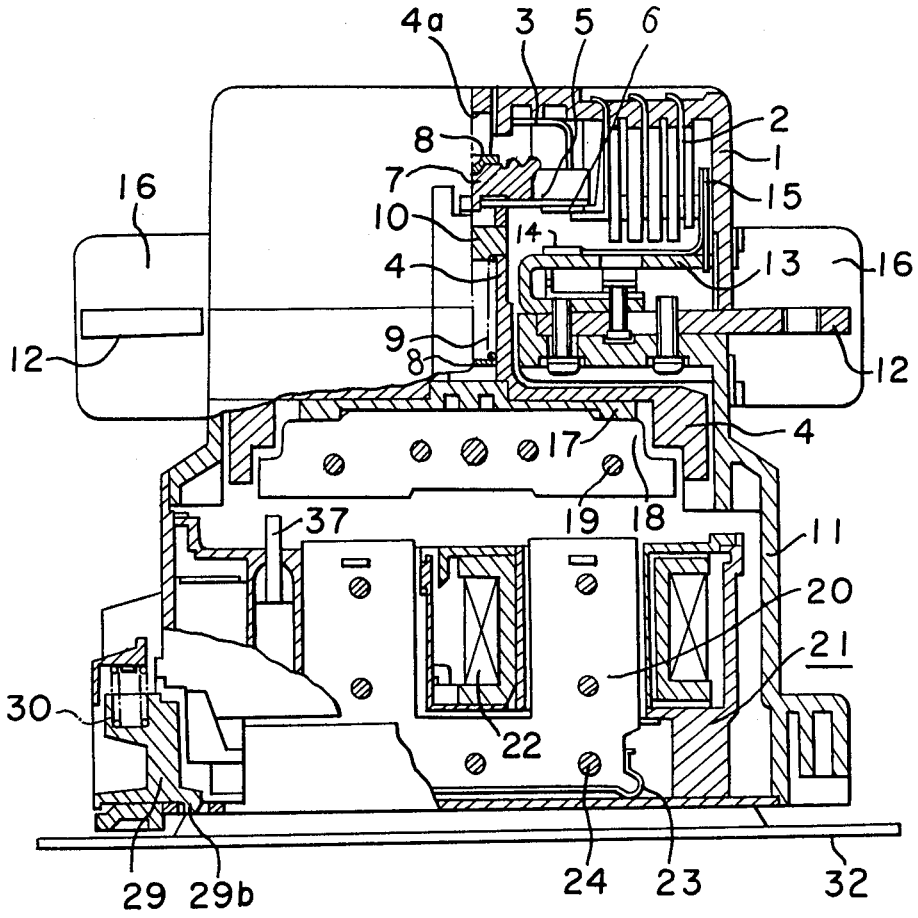
FIG. 4 is a cross-sectional view of the main part of one preferred embodiment of the electromagnetic contact device according to the present invention.
Figure 5:
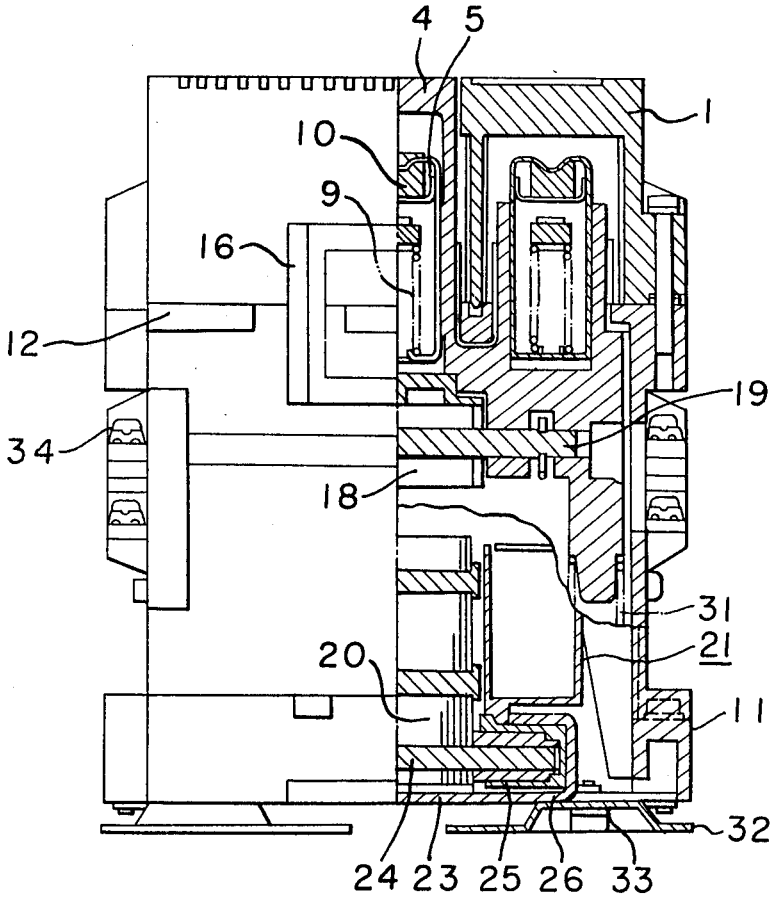
FIG. 5 is a side elevational view, half in cross-section, of the electromagnetic contact device shown in FIG. 4.

FIG. 4 shows the cross-sectional view of the front part of the first embodiment according to the present invention, while FIG. 5 indicates the side elevational view, half in cross-section, of the electromagnetic contact device.

Figure 4A:
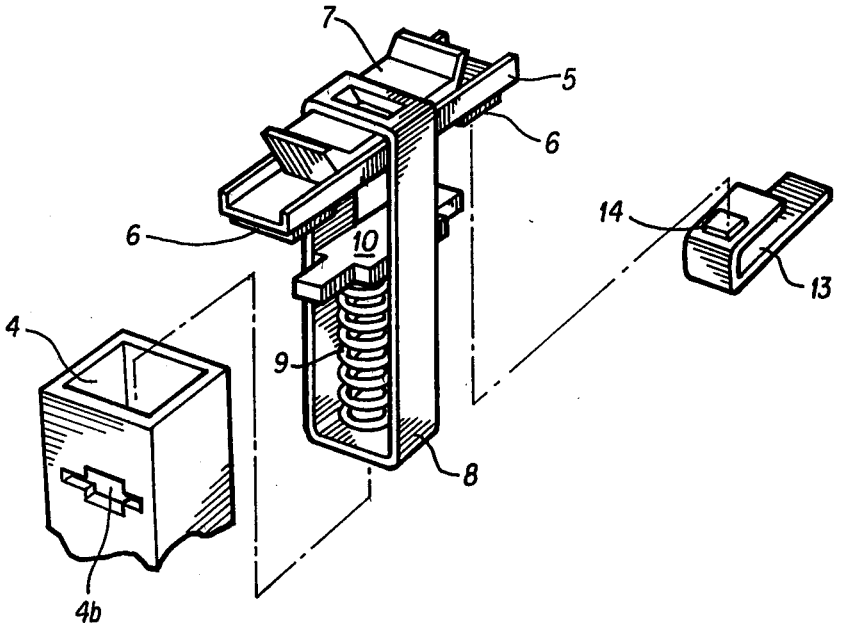
FIG. 4*a* is a detail of the movable contact member assembly in FIG. 4.
Figure 6:
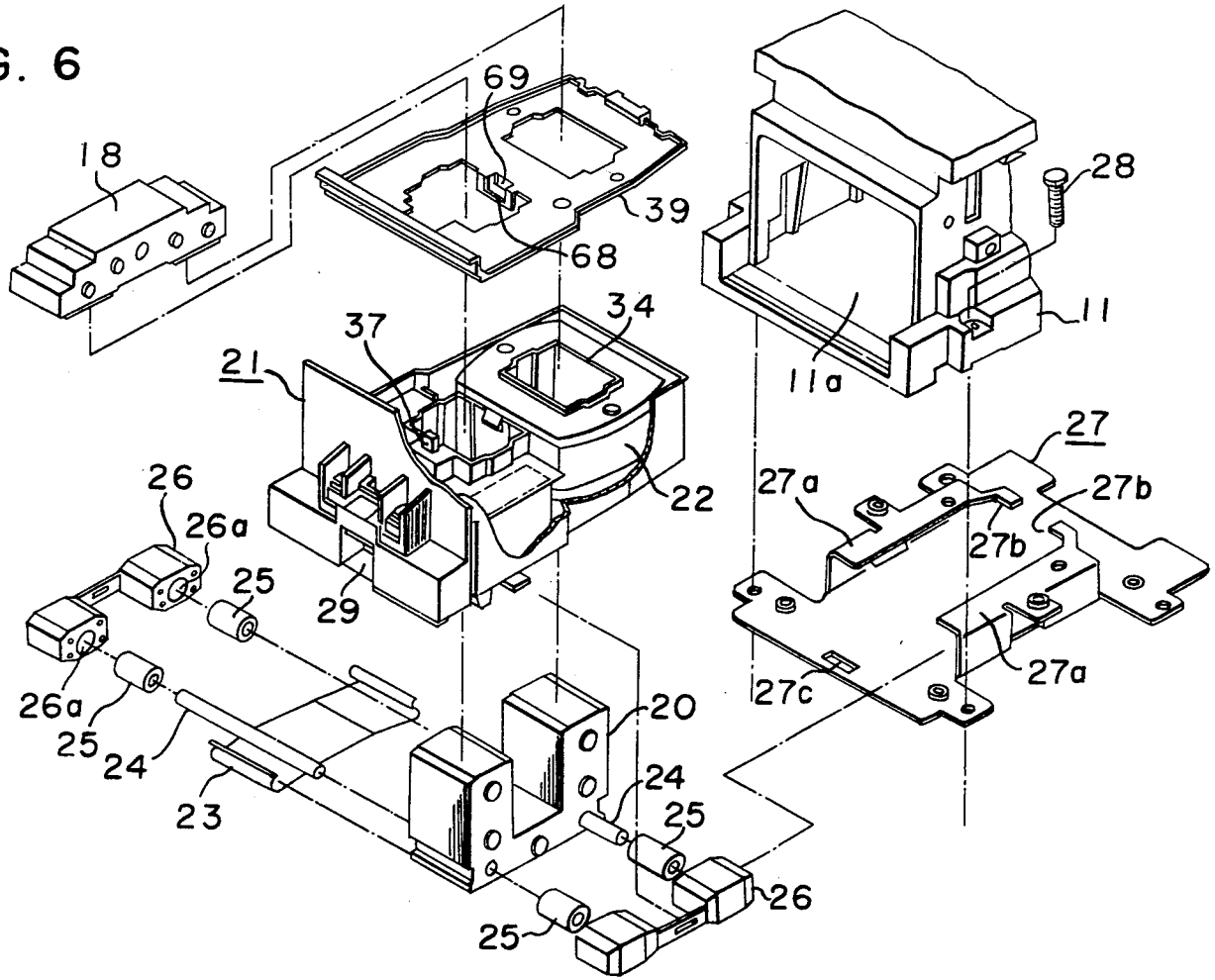
FIG. 6 is an exploded perspective view of a driving part of contact device to actuate the movable iron core.
Figure 7:
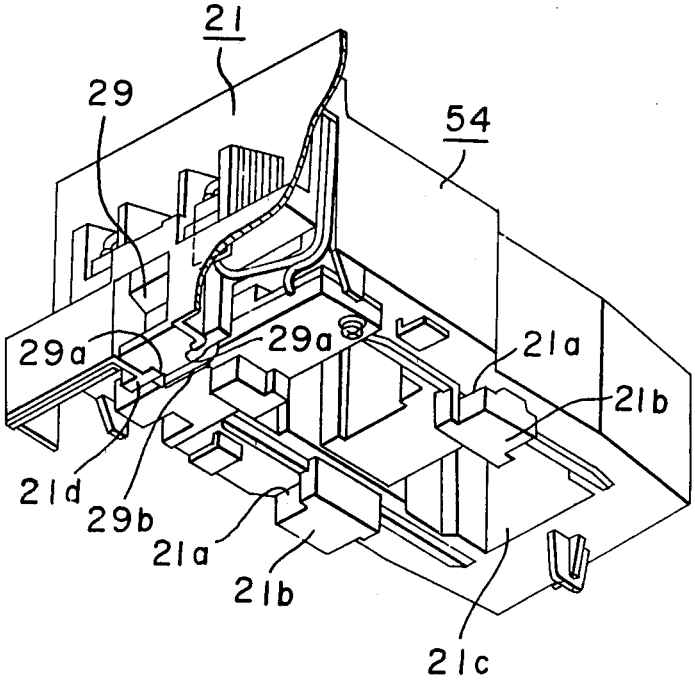
FIG. 7 is a perspective view of a drive control device as seen from the bottom part thereof.

In FIGS. 4, 4*a* and 5, a reference numeral 1 designates an arc box for extinguishing an arc, which is made of a refractory material. Grids 2 and commutating plates 3 made of magnetic metal material are fixedly provided in the arc box in correspondence to the phase number of the electric path to be opened and closed. A reference numeral 4 designates the cross-bar, a numeral 5 refers to the movable contact piece, a numeral 6 denotes the movable contact point fitted at the end of the movable contact piece 5, a numeral 7 indicates a pressing member for the movable contact piece, a numeral 8 refers to a supporting member for a pressing spring, a numeral 9 designates a spring for the contact piece, and a numeral 10 indicates a stopper. The contact piece spring 9 is fixedly provided, in compression, between the lower part of the stopper 10 and the bottom end part of the pressing spring supporter 8. The top end part of the pressing spring supporter 8 and the upper surface of the movable contact piece pressing member 7 are in contact as are the upper surface of the movable contact piece 5 and the lower surface of the movable contact piece pressing member 7. The ends of stopper 10 are inserted in stopper holes 4*b* of the cross-bar. A reference numeral 11 designates the base member in such a shape that its bottom part is open and its lateral side has an opening 11*a* for taking out an electromagnetic driving device to be described later, as shown by the exploded perspective view in FIG. 6. A reference numeral 12 designates a terminal fixed on the top part of the base member 11 with a screw, and a numeral 13 refers to the fixed contact piece in the shape of an angled U which is screw-fastened on the upper surface of the terminal 12. On the upper surface of the fixed contact piece, there is fitted the fixed contact point 14. A reference numeral 15 designates an arc runner fixed on the fixed contact piece 13. A numeral 16 refers to an insulating barrier which serves for electrical insulation between the above-mentioned terminals 12, 12. A part of this insulating barrier is inserted in, and fixedly held by, grooves (not shown) formed in the arc box 1 and the base member 11. A reference numeral 17 designates a movable buffer rubber, and a numeral 18 refers to the movable iron core which is connected to and fixed at the lower part of the cross-bar 4 with movable iron core pins 19. A numeral 20 refers to the fixed iron core which is disposed in opposition to the movable iron core 18 with a predetermined space gap between them. A numeral 21 refers to the electromagnetic drive control device (hereinafter simply referred to as "drive control device") which is shown to be inserted through the fixed iron core 20. The drive control device contains in its interior the operating coil 22 such as an electromagnetic winding, and so on. Also, as shown in FIG. 7 which is a perspective view of the drive control device 21 as seen from its bottom, a rail engaging piece **21*b* is provided on the bottom part to form an angled "U"-shaped recess 21*a*. Incidentally, a reference numeral 21*c* designates a through-hole, into which the above-mentioned fixed iron core 20 is inserted. A reference numeral 23 designates a fixed buffer spring which is provided on the bottom part of the fixed iron core 20 and mainly functions to alleviate impact caused to the surface of a fitting table (not shown) at the time of closure of the electromagnetic contact device. A numeral 24 refers to pins for the fixed iron core, which are provided in a manner to pass through the bottom part of the fixed iron core 20 as shown in FIGS. 5 and 6, and both ends of which are projected outwardly from the fixed iron core 20. Both ends of the fixed iron core pin 24 are capped with fixed rubber buffers 25. A guide 26 is further mounted on and around this fixed rubber buffer 25 in a manner to cover the same. The guide 26 is made of a material having a small frictional resistance, in which a recess 26*a* of a size substantially equal to the outer diameter of the fixed rubber buffer 25 is formed. A reference numeral 27 designates a railing plate with a pair of mutually parallel rails 27*a*, 27*a* being formed at the middle portion thereof in the form of an angled "U". A rail stopper 27*b* is formed at the innermost end of each rail 27*a*. The railing plate 27 is fastened to the base member 11 with tightening screws 28. A ratchet 29 is also incorporated in one part of the drive control device 21 as shown in FIGS. 4 and 7. The ratchet 29 is supported at the recessed portion 29*a* of the same by a vertically protruded portion 21*d* of the drive control device 21 in a manner to be freely movable up and down, and is further biased downwardly with a return spring 30. An engaging projection 29*b* is formed at the lower part of the ratchet 29, which is so constructed as to be engaged with an engaging hole 27*c* formed in one part of the railing plate 27. A numeral 31 refers to a take-off spring which is disposed in a space between the bottom end of the cross-bar 4 and the upper surface of the railing plate 27 to exert a constant upward biasing force on the cross-bar 4. A reference numeral 32 designates a fitting plate having holes 33 for fixedly securing the electromagnetic contact device to a mounting table (not shown). The fitting plate is fastened to the railing plate 27 with tightening screws. A numeral 34 denotes an auxiliary contact point portion and is fixed to the lateral surface of the base member 11. Incidentally, the arc box 1 is fixed on the base member 11 with tightening screws, and the cross-bar 4 is held and guided by the inner wall of the base member 11** in a manner to be freely movable in the up and down direction.

Figure 8:
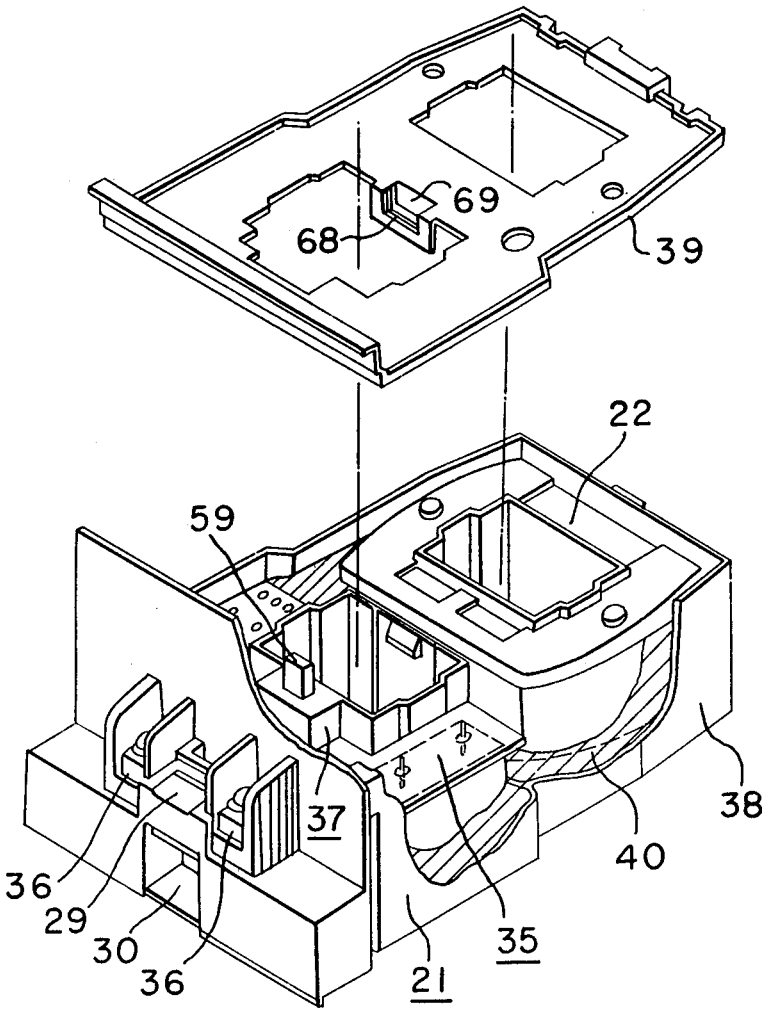
FIG. 8 is also a perspective view of the drive control device as seen from the top part thereof.

The structure of the above-described drive control device 21 will now be explained in detail in reference to FIG. 8. A reference numeral 22 designates the operating coil to generate magnetic flux, by which the movable iron core 18 is attracted to and held on the fixed iron core 20. Numeral 35 denotes a control circuit electrically connected to the operating coil 22 for controlling the magnetic flux generated by the operating coil 22. Numeral 36 refers to a winding terminal for applying alternating current voltage from the power source to the control circuit part 35. Numeral 37 refers to the change-over switch for changing over the control circuit to switch the flowing direction of the current in the operating coil 22 at the time of attracting the movable iron core 18 to the fixed iron core 20, and at the time of holding them together. Numeral 38 indicates a coil casing fixed on the railing plate 27, the casing 38 accommodating therein the operating coil 22, the control circuit part 35, the winding terminal 36, and the change-over switch 37. Numeral 39 refers to a cover for covering, insulating, and preventing dust in the upper surface of the coil casing 38. Numeral 40 refers to a mold material which is poured in and solidified after the operating coil 22, the control circuit part 35, and the change-over switch part 37 have been accommodated in the coil casing 38.

Figure 9:
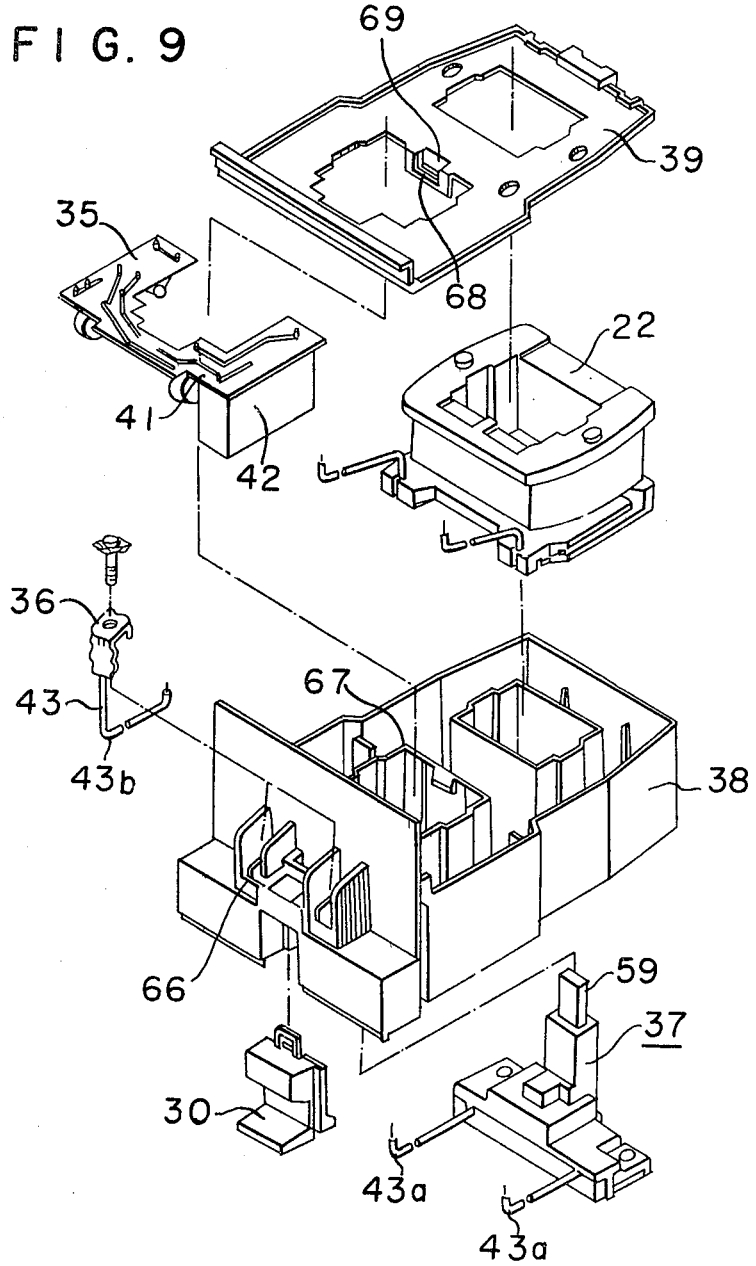
FIG. 9 is an exploded perspective view of the drive control device shown in FIG. 8.
Figure 10:
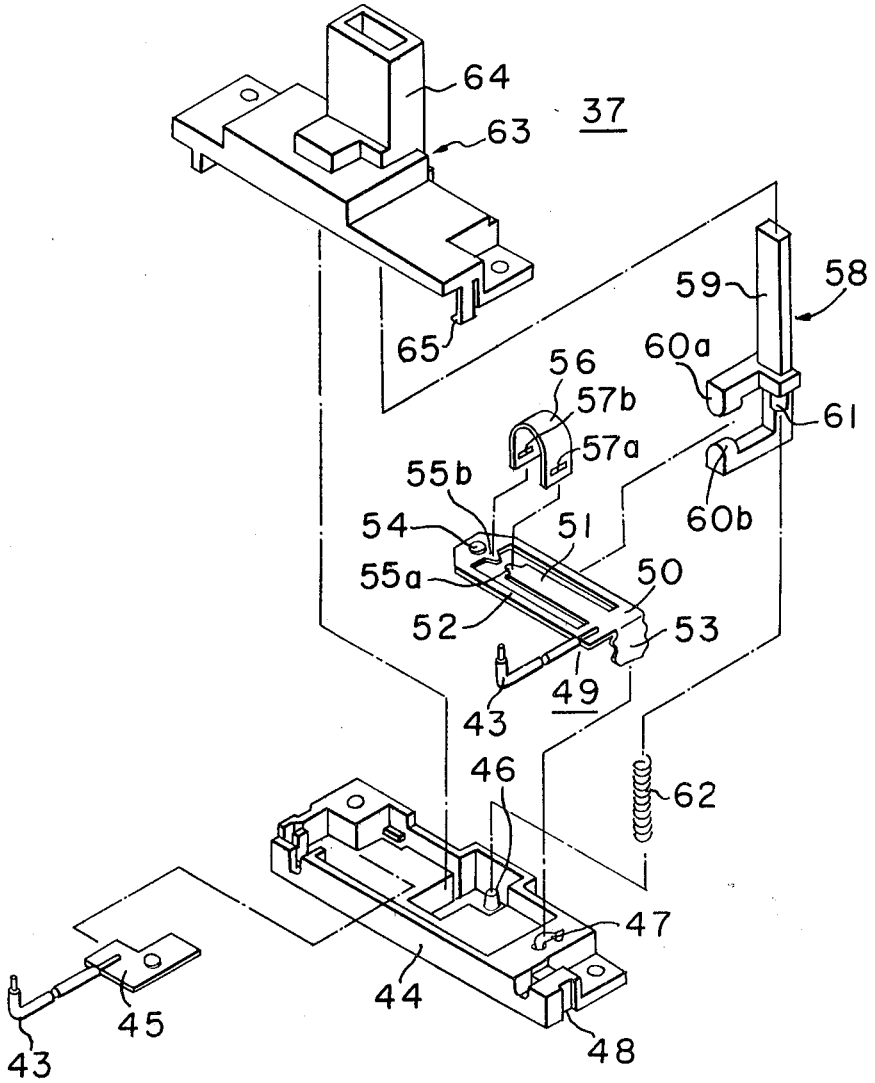
FIG. 10 is an exploded perspective view of the changeover switch portion.

The control circuit 35, as is shown in FIG. 9 illustrating an exploded view of the drive control device 21, comprises a printed base plate 41 and a circuit element 42 which are electrically connected with the winding terminal 36, the change-over switch 37, and the operating coil 34 through a lead wire 43. As shown in the exploded perspective view of FIG. 10, the change-over switch 37 is so constructed that a switch base 44 to be mounted on the base member of the main body of the electromagnetic contact device has a recessed portion formed at the center of its upper surface, the fixed contact 45 is secured on the bottom wall portion of the above-mentioned recessed portion, and a spring receiving portion 46 is formed at the other portion of the bottom wall portion. On one end of the upper surface of the switch base 44, there is further formed a fitting hole 47 to fit therein a resilient contact point to be mentioned hereinafter. On the lateral surface of the above-mentioned base member 44, there is formed a switch cover engaging groove 48 to be mentioned later. The elastic contact point 49 has a base part 50, and an elastic piece 51 and the contact piece 52, each projecting from the base part 50. A fitting member 53 projects from the base part 50, and is fixedly secured in the fitting hole 47 formed in the switch base 44. The contact piece 52 is further formed in the base part 50 in a manner to surround the elastic piece 51. At the distal end part of the contact piece 52, there is provided a contact point 54 which connects with or disconnects from the fixed contact point 45 on the switch base 44. At the free ends of the mutually confronting elastic piece 51 and contact piece 52, there are formed respective engaging pawls **55*a*, 55*b***.

These engaging pawls **55*a*, 55*b* have a click engaging spring 56 provided in a manner to bridge them both together. That is to say, the click spring 56 is formed by bending a leaf spring in the form of a letter "U", both distal end parts of which have engaging holes 57*a*, 57*b* to be engaged with the above-mentioned engaging pawls 55*a*, 55*b*, hence it is engaged with the engaging pawls 55*a*, 55*b*** in a state of its being deformed by compression.

A push rod 58 is provided for performing the on-off operations between the above-mentioned elastic contact point 49 and the fixed contact point 45. The push rod 58 comprises a sliding part 59 formed on the upper half thereof to slide up and down in and along a guide barrel to be mentioned later, and two operating arms 60*a*, 60*b* to press-deform the above-mentioned elastic piece 51 upwardly or downwardly, the operating arms projecting from the lower half of the push rod in a manner to oppose the upper and lower surfaces of the elastic piece 51. A spring receiving projection 61 is formed at the root part of the operating arm 60*a*. One end of this push rod 58 is engaged with, and fixed to, the movable iron core 18 in the elastromagnetic contact device. The up-and-down movement of the push rod 48 is achieved along with the vertical movement of the movable iron core 18, thereby making it possible to deform the elastic contact point 49 either upward or downward.

A spring 62 is interposed between the push rod 58 and the switch base 44. That is to say, one end of the spring 62 is engaged with the spring receiving portion 46 of the switch base 44, and the other end thereof is engaged with the spring receiving projection 61 of the push rod 58, whereby the push rod is constantly biased upward.

A switch cover 63 is fitted on the above-mentioned switch base 44. In more detail, a push rod sliding guide barrel 64 is uprightly provided from the top surface of the switch cover 63, and an engaging piece 65 projects downwardly from one lateral surface side of the switch cover 63. By inserting the sliding part of the push rod 58 into the guide barrel 64 and engaging the engaging piece 65 with the engaging groove 48 formed in the switch base 44, the switch cover 63 can be snugly fitted onto the switch base 44.

The lead wire 43*a* extended from the change-over switch 37 passes through a notched groove 66 in the coil casing 38 and connected with the printed base plate 41 of the control circuit part 35 by soldering. The above-mentioned winding terminal 36 is pushed into and fixed at the coil casing 38, while the lead wire 43*b* extended from the coil terminal 36 passes through the notched groove 66 of the coil casing 38 and is connected with the printed base plate 41 of the control circuit part 35 by soldering.

The above-mentioned poured mold 40 fills up to the upper surface of the printed base plate 41, and serves for insulation among the patterns of the printed base plate 41 and among the corresponding groundings. The mold also functions to efficiently dissipate heat generated from the operating coil 22 and circuit components, and to protect them from moisture. The above-mentioned coil cover 39 has a hooking part 68 to fit with the projection 67 of the coil casing 38, which is secured to the coil casing 38. When the poured mold 40 becomes solidified after its pouring, the coil cover 39 becomes fixed and no longer separable from the coil casing 38 by a projection 69 to be embedded in and fixed by the poured mold upon its solidification. The coil cover 39 has a dust-preventive role for the control circuit part 35 and the operating coil 34, which serves for the electrical insulation, in case such insulation is insufficiently attained by the poured mold 40 alone.

Figure 2:
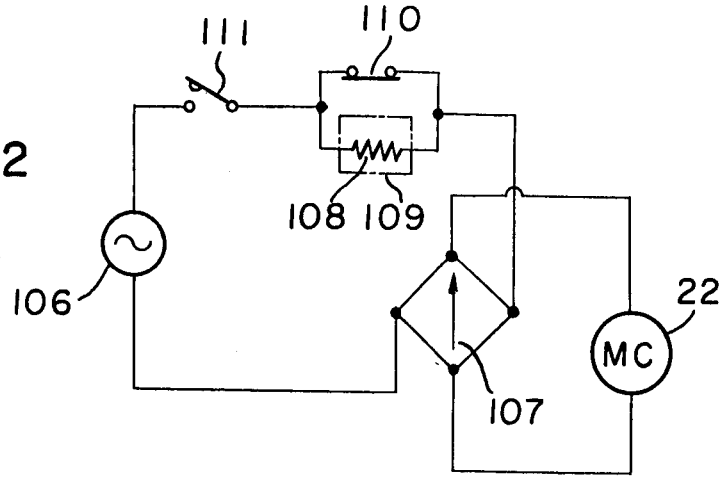
FIG. 2 PRIOR ART
FIG. 2 is a circuit diagram for the operating coil in the conventional electromagnetic contact device.
Figure 3A:
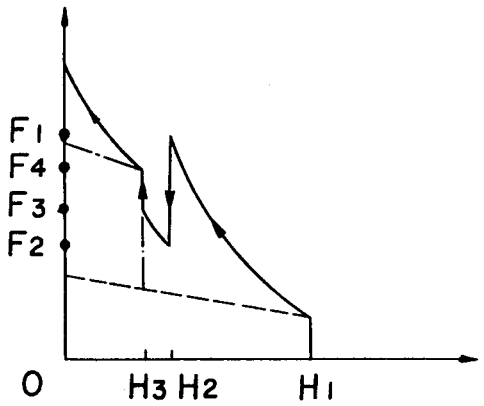
FIG. 3A PRIOR ART
FIGS. 3A and 3B are respectively graphical representations showing a relationship between a distance of both iron cores and a core attracting force in the conventional electromagnetic contact device, the former being a case where the main circuit is closed and the latter being a case where it is opened.
Figure 3B:
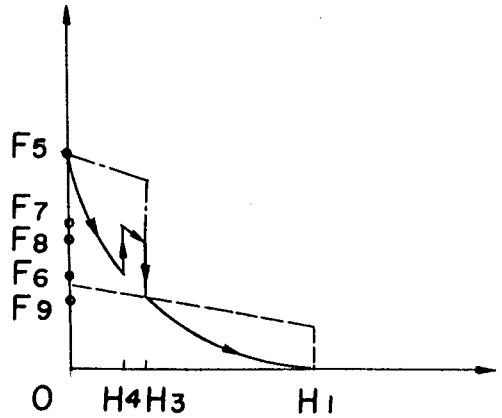
FIG. 3B PRIOR ART
Figure 11:
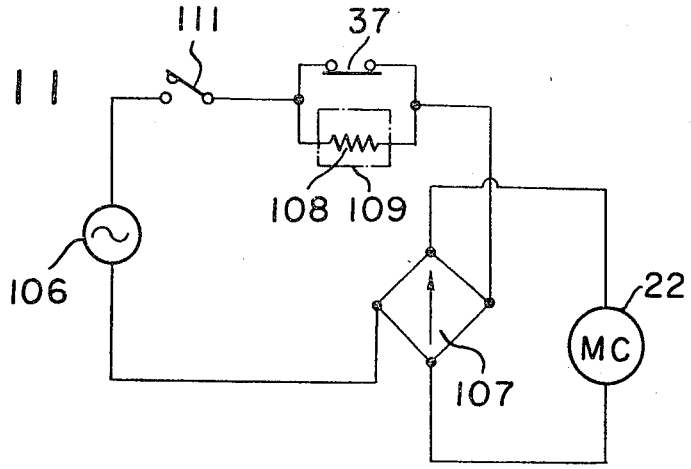
FIG. 11 is an electrical circuit diagram for the first embodiment of the electromagnetic contact device of the present invention as shown in FIGS. 4–10.

The electrical circuit for the drive control device 21 is constructed as shown in FIG. 11. In the drawing, a numeral 37 refers to the change-over switch, the other circuit components being same as those shown in FIG. 2.

In the following, explanations will be given as to the operations of the electromagnetic contact device according to the first embodiment of the present invention as in the above-described construction.

In FIGS. 4, 4*a* and 5, when the electromagnetic conductor is not energized, the bottom surface of the movable contact piece 5 is in contact with the upper surface of the cross-bar 4 due to spring 9 urging spring supporter 8 downward as a result of stopper 10 engaging in stopper hole 4*b*. When a driving voltage is applied to the drive control device 21, electromagnetic attractive force is generated between the movable iron core 18 and the fixed iron core 20 by the magnetic flux which the drive control device 21 has produced, whereby the cross-bar 4 connected with the movable iron core 18 moves downward against the take-off spring 31, and the movable contact point 6 and the fixed contact point 14 come into contact. Since the gap between the movable iron core 18 and the fixed iron core 20 is larger than the contact gap between the movable contact point 6 and the fixed contact point 14, the cross-bar 4 continues to move downward from the contact position between the above-mentioned contact points to thereby close the iron cores. On account of this closure, the contact piece spring 9 is deformed by compression, the spring pressure of which is transmitted to the movable contact piece 5 through the pressing spring support 8 and the movable contact piece pressing member 7, to provide electrically conduction between the terminal 12 and the opposite terminal 12, with a predetermined contact pressure.

When the drive voltage applied to the drive control device 21 is removed, the electromagnetic attractive force between the movable iron core 18 and the fixed iron core 20 is extinguished, and the cross-bar 4 is moved upward by the energizing force of the take-off spring 31 which has so far been compressed, whereby both contact points are separated. At this instant, there occurs an arc between the movable contact point 6 and the fixed contact point 14. This arc, however is commutated from the movable contact point 6 to the commutation plate 3, and from the fixed point 14 to the arc runner 15, respectively, is further drawn into the grids 2 by electromagnetic repulsive force due to the arc current and the contact piece current, and is cooled and split to be extinguished. The opening and closing operations of the electric path connected between the terminals 12, 12 can be done by opening and closing the drive voltage of the drive control device 21, as mentioned in the foregoing.

Figure 12:
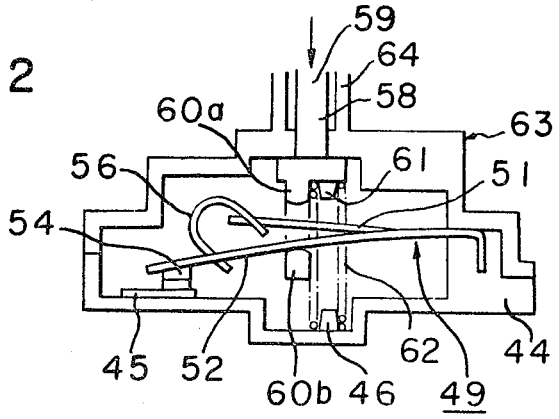
FIGS. 12 to 14 are explanatory diagrams for operations of the change-over switch shown in FIG. 10.
Figure 13:
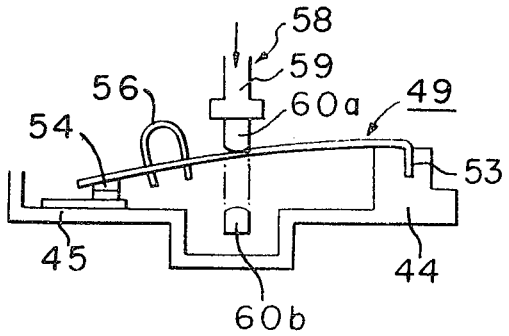
Figure 14:
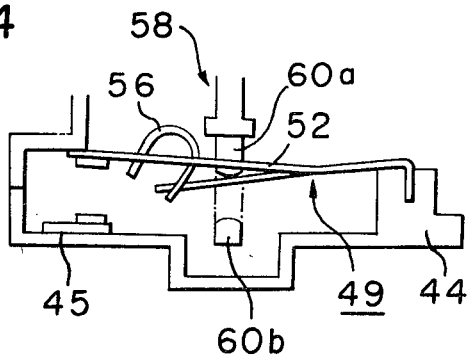

The change-over switch 37 functions in the manner as shown in FIGS. 12 to 14 which illustrate the behavior of the change-over switch 37 from the opened state of the electric path to its closed state. FIG. 12 shows a state where the electric path is opened, i.e., a state where the movable iron core 18 is separated from the fixed iron core 20. In this state, the elastic contact point 49 is biased downward by the click spring 56, and this elastic contact point 49 is press-contacted to the fixed contact point 45. When the power source 106 is turned on by the switch 111, energizing current of a large capacity is supplied to the operating coil 34, the movable iron core 18 is attracted to the fixed iron core 20, the push rod 58 lowers against the upward biasing force of the spring 62 due to the downward movement of the cross-bar 4, and the elastic piece 51 is deformed by downward depression of the operating arm 60*a*. In this instance, the click spring 56 is compression-deformed and elastic energy is accumulated. Before the elastic piece 51 is deformed to the dead center position as shown in FIG. 12, the state of contact between the elastic contact point 49 and the fixed contact point 45 is maintained. When the deformation of the elastic contact point 49 exceeds the dead center, due to the movable iron core 18 being attracted to the fixed iron core 20, the control points 14, 6 come into mutual contact to close the electric path. At the time of this closure of the electric path, the compression-deformation of the click spring 56 is removed, the contact piece 52 is upwardly deformed due to expansion of the click spring 56. As a result the state of contact between the elastic contact point 49 and the fixed contact point 45 is removed with the consequence that the power source voltage is divided by the resistor 108 and a small capacity current is supplied to the rectifying circuit 107.

The behavior of the change-over switch 37 from the closed state of the electric path to its open state is achieved by following the opposite route to that from the open state of the electric path to its closed state. In this case, it may be understood that the elastic contact point 49 is separated from the fixed contact point 45 after the movable iron core 18 has been separated from the fixed iron core 20 by a degree, and that the so-called hunting phenomenon can be prevented even when the voltage to be applied to the operating coil 22 lowers due to trouble, etc. of the device, whereby the fusion-bonding between the movable contact point 6 and the fixed contact point 14 in the main circuit can be prevented.

In the following, the function of the change-over switch 37 will be explained in reference to FIGS. 15A and 15B.

Figure 15A:
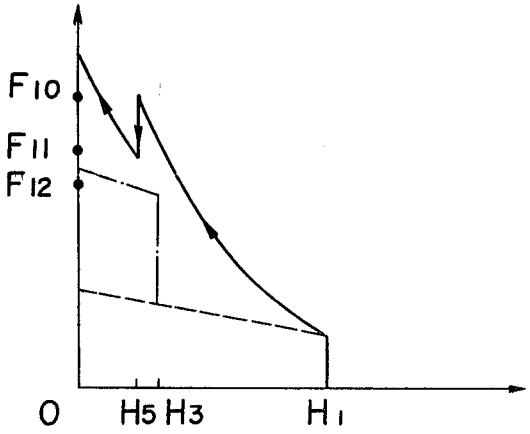
FIGS. 15A and 15B are respectively graphical representations showing a relationship between a spacing of iron cores and a core attracting force in the electromagnetic contact device according to the present invention, the former being a case where the main circuit thereof is closed and the latter being a case where it is opened.

FIG. 15A shows the relationship between the spacing of iron cores 20, 18 and the core attracting force when the above-mentioned main circuit is closed. By the closure of the switch 111, the core attracting force gradually increases, according to which the distance between iron cores 20, 18 becomes gradually reduced from the point $H_1$. After the two contact points 14, 6 are closed, i.e., when the distance between iron cores 20, 18 reaches the point $H_5$, the change-over switch 37 performs its off-operation with the consequence that the core attracting force decreases from $F_{10}$ to $F_{11}$, after which it increases again to resume attraction of iron cores 20, 18 with a predetermined attractive force $F_{12}$.

Thus, according to this first embodiment of the present invention, since the timing for the off-operation of the change-over switch 37 is established after the closure of contact points 14, 6, the core attracting force $F_{11}$ is always stronger than a sum $F_{12}$ of the biasing force of the take-off spring 31 and the biasing force of the contact piece spring 9, when the change-over switch performs its off-operation. Accordingly, the change-over and supplying operations of the driving voltage to the operating coil can be done without failure.

Figure 15B:
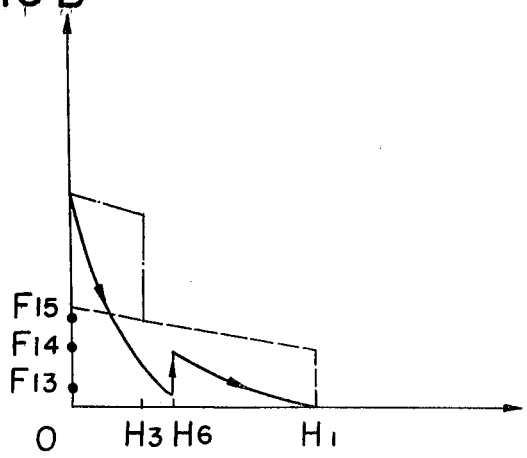

FIG. 15B shows a relationship between the spacing of iron cores 20, 18 and the core attracting force when the voltage to be applied to the above-mentioned operating coil 22 is lowered. Owing to the lowered voltage level to the operating coil 22, the core attracting force gradually decreases, according to which the distance between the two iron cores 20, 18 gradually increases. In other words, only after the contact points 14, 6 have been separated, i.e., the distance between iron cores 20, 18 reaches the point $H_6$, the change-over switch 37 performs its on-operation with the consequence that the core attracting force increases from $F_{13}$ to $F_{14}$, and then it again decreases to perform the separating action of iron cores 20, 18. Thus, according to this embodiment, since the timing for the on-operation of the change-over switch 37 is established to occur after separation of the two contact points 14, 6, the core attracting force $F_{14}$ is always weaker than the biasing force $F_{15}$ of the take-off spring 31 when the change-over switch 37 performs its on-operation. Accordingly, the change-over and supplying operations of the driving voltage to the operating coil 22 can be performed without failure.

Furthermore, as stated in the foregoing, since the change-over switch 37 performs its switching operation by the actuation of the movable iron core 18, there is no necessity for providing any additional parts for the switching operation of the type without which the switching operation can be effected accurately. Moreover, since the change-over switch 37 is integrally constructed with the operating coil 22, mounting and dismounting of the operating coil 22 for exchange can be done easily.

Figure 16:
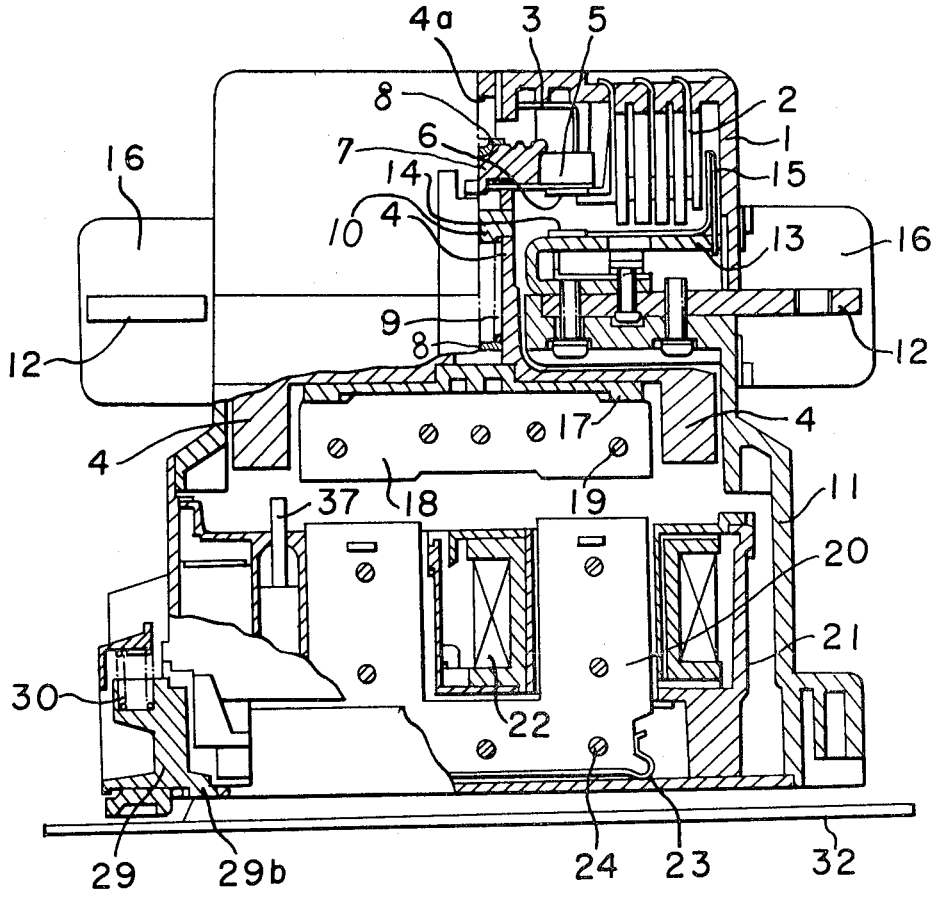
FIG. 16 is a cross-sectional view of the main part of another preferred embodiment of the electromagnetic contact device according to the present invention.

FIG. 16 illustrates the second preferred embodiment of the electromagnetic contactor according to the present invention, wherein those component parts identical with those in the above-described first embodiment are designated by the same reference numerals, and the explanations therefor will be dispensed with.

In this second embodiment, the change-over switch 37 is so constructed that it may perform its switching operation by the actuation of the cross-bar 4. Accordingly, there is no necessity for separately providing the parts for the switching operation, whereby wear of the change-over switch 37 due to the switching operation can be reduced.

Figure 17:
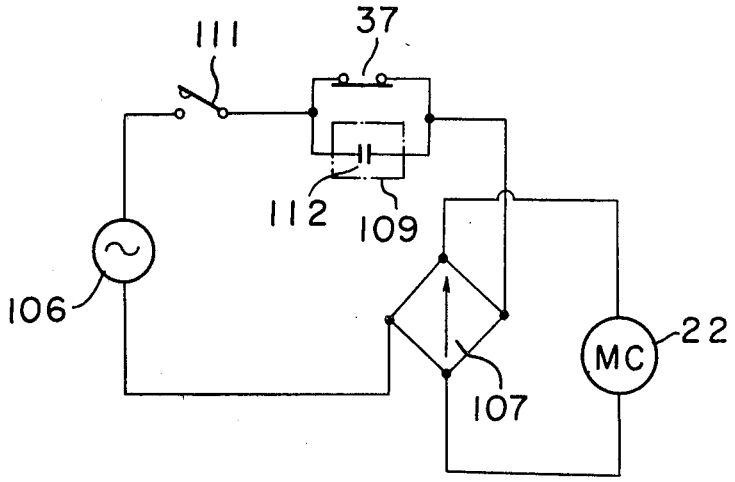
FIG. 17 is an electrical circuit diagram for energizing the operating coil in still another preferred embodiment of the electromagnetic contact device according to the present invention.

FIG. 17 shows a schematic view of the third preferred embodiment of the electromagnetic contactor according to the present invention, in which a capacitor 112 is used as a means for converting a large capacity current from the AC power source 106 to a small capacity current for driving the operating coil 22 after the movable iron core 18 has been attracted. In the drawing, those component parts which are identical with those in each of the afore-described embodiemnts are designated by the same reference numerals, and the explanations therefor will be dispensed with.

In this third embodiment, since the capacitor 112 is employed as the converting means, there is no voltage drop caused during the holding period of the operating coil 22 which comes after the operation of the change-over switch 37, whereby the power consumption is considerably reduced in comparison with that in the case of the first embodiment where the resistor 108 is utilized as the converting means.

Figure 18:
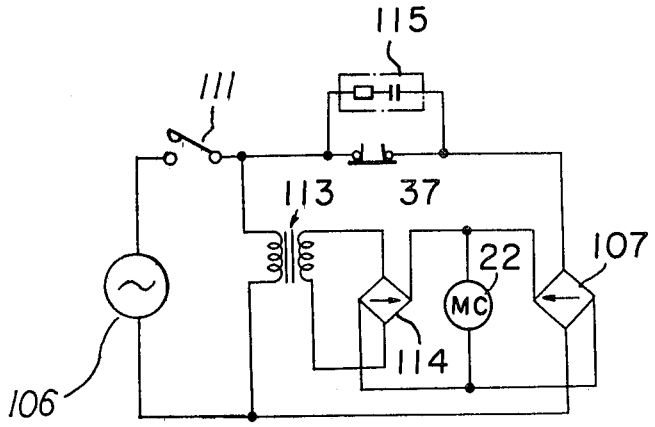
FIG. 18 is an electrical circuit diagram for energizing the operating coil in another preferred embodiment of the electromagnetic contact device according to the present invention.

FIG. 18 indicates the fourth preferred embodiment in the electromagnetic contactor according to the present invention which is constructed with a transformer 113 to drop a voltage from the AC power source 106 with the converting means, and the rectifying circuit 114 to rectify a small capacity output from the transformer 113 and supply it to the operating coil 22. In the drawing, those component parts which are identical with those in each of the afore-described embodiments are designated by the same reference numerals, and the explanations for them will be dispensed with.

In FIG. 18, a large capacity current and a small capacity current are selectively supplied from the AC power source 106 to the operating coil 22, for which purpose there are provided two systems of current feeding paths. The first path for a large capacity current includes a starting rectifying circuit 107, in which a power source voltage is supplied to the operating coil 22 through the change-over switch 37. This current is rectified to a large capacity direct current voltage, after which it is supplied to the operating coil 22. Incidentally, the above-mentioned change-over switch 37 is connected in parallel with a surge absorber 115, by which a surge voltage to occur with opening and closing of the change-over switch 37 is absorbed therein and relaxed.

On the other hand, the second path for a small capacity current includes a holding rectifying circuit 114. In order to supply a reduced AC output voltage to this rectifying circuit 114, a single phase transformer 113 is provided for reducing the power source voltage. Accordingly, the operating coil 22 can be subjected to an exact holding action with a small capacity current which has been lowered by the transformer 113 after completion of the attracting operation of the movable iron core 18, i.e., after the closure of the fixed contact point 14 and the movable contact point 6, as will become apparent from the function of the operating coil 22 to be described hereinafter.

The characteristic feature of this fourth embodiment is that the droppage in the power source voltage is effected by the single phase transformer 113, for which purpose the device of this embodiment is so constructed, unlike the previous embodimental devices, so that it provides the two rectifying circuits 107, 114. Therefore, the contact starting and contact holding of the movable iron core 18 to the fixed iron core 20 may be effected with the energizing current supplied from separate rectifying circuits for the respective functions.

The closing action of the electric path in this embodiment, i.e., the attraction of the movable iron core 18 to the fixed iron core 20 is done in the following manner.

When the movable iron core 18 is about to be attracted to the fixed iron core 20, the change-over switch 37 is closed, and the large capacity alternating current from the AC power source 106 is supplied to the starting rectifying circuit 107. This alternating current is subjected to full-wave rectification and then supplied to the operating coil 22. As the result of this, the fixed iron core 20 functions as an electromagnet, whereby the movable iron core 18 is attracted to the fixed iron core 20 and they are mutually contacted. At this time, the movable contact point 6 connected with the movable iron core 18 becomes in contact with the fixed contact point 14 disposed on the base member, etc. of the electromagnetic contacting device, whereby the electric path is closed.

In order to maintain the state of contact between the movable iron core 18 and the fixed iron core 20, as mentioned in the foregoing, a small capacity energizing current will suffice. For the purpose of saving the power consumption, the device according to this fourth embodiment is so constructed that the change-over switch 37 may be opened after the movable iron core 18 comes in contact with the fixed iron core 20. As the result of this, when the movable iron core 18 is in contact with the fixed iron core 20, the voltage from the power source 106 is divided by the single phase transformer 113 to be a small capacity alternating current, and a small capacity DC energizing current which has been rectified by the above-mentioned holding rectifier circuit 114 is supplied to the operating coil 22, and the state of contact of the movable iron core 18 to the fixed iron core 20 is maintained by the electromagnetic action of the fixed iron core 20, thereby continuously keeping the closed state of the electric path. In this way, the energizing current to the operating coil 22 is controlled.

According to this embodiment, the division of the power source voltage after the movable iron core 18 has been attracted is done by the single phase transformer 113, and the engergizing current to hold the electric path in its closed state may be of a small capacity, on account of which the above-mentioned single phase transformer 113 may be of a small capacity of a few VA. This makes it possible to miniaturize the device and to incorporate the same into the main body of the electromagnetic contacting device.

It is to be added further that the single phase transformer 113 is excellent in its heat-resistant property in comparison with the capacitor, owing to which property it can prevent damage due to heat, whereby a highly reliable electromagnetic contacting device can be provided.

As has so far been explained, the electromagnetic contactor according to the present invention comprises the change-over switch which is provided in the holding circuit of the operating coil and connected in parallel with the converting means to convert a large capacity current from the power source to a small capacity current for driving the operating coil upon contact of the movable contact point with the fixed contact point, and this change-over switch possesses such a hysteresis characteristic that it performs the off-operation after closure of the fixed contact point and the movable contact point when the main circuit is closed, and performs the on-operation after separation of the above-mentioned two contact points when the voltage to be applied to the operating coil has been lowered. On account of such construction and characteristic, there occurs no hunting phenomenon between the two contact points not only during the closure of the fixed contact point and the movable contact point, but also even when the voltage to be applied to the operating coil has been lowered, so that the present invention is able to provide the electromagnetic contacting device capable of preventing the fusion-bonding from taking place between the contact points.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An electromagnetic contacting device, comprising in operative combination:

a base member with a fixed contact point mounted thereon;

a cross-bar provided on said base member in a freely slidable manner and on which a movable contact point is mounted to open and close a main circuit in cooperation with said fixed contact point;

a fixed iron core on said base member;

a movable iron core mounted on said cross-bar for shifting said movable contact point;

an operating coil in combination with said fixed iron core to generate a predetermined energizing force;

a starting circuit to rectify a large capacity electric current from an AC power source, and to supply the rectified current to said operating coil;

a holding circuit including a converting means to supply said large capacity current from said power source to said operating coil through said converting means to convert the large capacity current to a small capacity when said iron cores are in contact; and a change-over switch to change an energizing current for said operating coil from said starting circuit over to said holding circuit, said change-over switch including a hysteresis means to cause said change-over switch to activate said holding circuit only after closure of both said contact points, and to deactivate said holding circuit only after separation of both said contact points.

2. The electromagnetic contacting device as set forth in claim 1, wherein said change-over switch performs the switching operation by the movement of said movable iron core.

3. The electromagnetic contacting device as set forth in claim 1, wherein said change-over switch performs its switching operation by the movement of said cross-bar.

4. The electromagnetic contacting device as set forth in claim 1, wherein said change-over switch is integrally constructed with said operating coil.

5. The electromagnetic contacting device as set forth in claim 1, wherein said converting means comprises a capacitor.

6. The electromagnetic contacting device as set forth in claim 1, wherein said converting means comprises a transformer to lower a voltage from said source of energizing current, and a rectifying circuit to rectify a small capacity output voltage from said transformer and supply the same to said operating coil.

7. The contact device according to claim 1 wherein said hysteresis means comprises an elastic contact point including a contact piece and an elastic piece, said pieces being alternately urged by a click engaging spring to opposite end positions relative to each other corresponding to an off- and on-position respectively of said elastic contact point, and wherein said elastic piece is actuated by means of said movable iron core via a push rod so as to actuate said elastic piece in such a manner that said contact piece is in said off-position after said elastic piece has been brought into an opposite end position by said push rod.

* * * * *

REEXAMINATION CERTIFICATE (465th)

United States Patent [19]

Yoshida et al.

[11] B1 4,481,555

[45] Certificate Issued Feb. 11, 1986

[54] ELECTROMAGNETIC CONTACT DEVICE

[75] Inventors: Masayuki Yoshida; Fumio Matsumoto; Shigeharu Otsuka, all of Nagoya, Japan

[73] Assignee: Mitsubishi Denki Kabushiki Kaisha, Tokyo, Japan

Reexamination Request:
No. 90/000,782, May 20, 1985

Reexamination Certificate for:

| | |
|---|---|
| Patent No.: | **4,481,555** |
| Issued: | **Nov. 6, 1984** |
| Appl. No.: | **420,913** |
| Filed: | **Sep. 21, 1982** |

[30] Foreign Application Priority Data

Sep. 24, 1981 [JP] Japan ..... 56-151258

[51] Int. Cl.[4] ..... H01H 47/10

[52] U.S. Cl. ..... 361/155; 361/156; 361/194; 361/206

[58] Field of Search ..... 361/154, 155, 156, 194, 361/206

[56] References Cited

FOREIGN PATENT DOCUMENTS 1126284 3/1962 Fed. Rep. of Germany .
1267311 5/1968 Fed. Rep. of Germany .
1960775 6/1971 Fed. Rep. of Germany .
2834780 2/1980 Fed. Rep. of Germany .

*Primary Examiner*—Harry E. Moose, Jr.

[57] ABSTRACT

An electromagnetic contact device performs on-off operations for opening and closing an electrical path, without causing the hunting phenomenon between the two contact points in the device not only during closure of a fixed contact point and a movable contact point therein, but also when a voltage to be applied to an operating coil has lowered. An operating coil generates a predetermined energizing force in combination with a fixed iron core, a starting circuit rectifies a large capacity electric current from an AC power source when attracting a movable iron core and supplies the rectified current to the operating coil. A holding circuit supplies the large capacity current from the AC power source to the operating coil through means of converting the large capacity current to a small capacity current at the time of holding the movable iron core. A change-over switch changes the energizing current supply source for the operating coil from the starting circuit to the holding circuit, the change-over switch having a hysteresis characteristic such that it performs its off-operation after closure of both contact points when the main circuit is closed, and performs its on-operation after separation of both contact points when the voltage to be applied to the operating coil has been lowered.

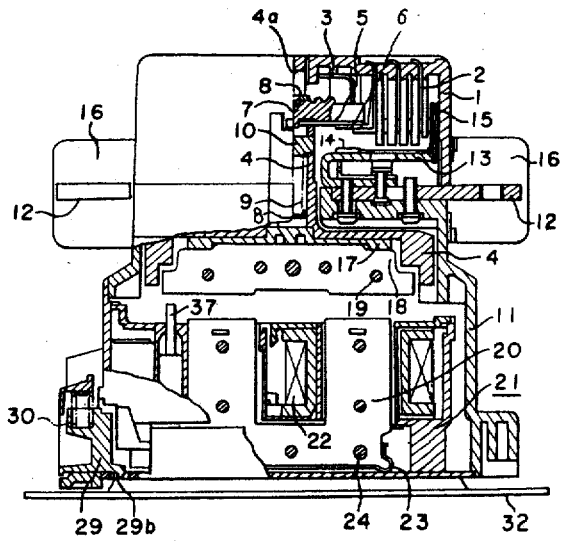

REEXAMINATION CERTIFICATE ISSUED UNDER 35 U.S.C. 307

NO AMEMDMENTS HAVE BEEN MADE TO THE PATENT

AS A RESULT OF REEXAMINATION, IT HAS BEEN DETERMINED THAT:

The patentability of claims 1–7 is confirmed.

* * * * *